US010269252B2

(12) United States Patent
Greene

(10) Patent No.: US 10,269,252 B2
(45) Date of Patent: Apr. 23, 2019

(54) AIRCRAFT TRAFFIC COLLISION AVOIDANCE

(71) Applicant: Safe Flight Instrument Corporation, White Plains, NY (US)

(72) Inventor: Randall A. Greene, White Plains, NY (US)

(73) Assignee: Safe Flight Instrument Corporation, White Plains, NY (US)

( * ) Notice: Subject to any disclaimer, the term of this patent is extended or adjusted under 35 U.S.C. 154(b) by 0 days.

(21) Appl. No.: 14/881,059

(22) Filed: Oct. 12, 2015

(65) Prior Publication Data

US 2017/0103661 A1 Apr. 13, 2017

(51) Int. Cl.
*G08G 5/00* (2006.01)
*G08G 5/04* (2006.01)

(52) U.S. Cl.
CPC ..... *G08G 5/0021* (2013.01); *G08G 5/0008* (2013.01); *G08G 5/0052* (2013.01); *G08G 5/0078* (2013.01); *G08G 5/045* (2013.01)

(58) Field of Classification Search
CPC ..... G08G 5/045; G08G 5/0078; G08G 5/04; G08G 5/0021; G08G 5/0013; G08G 5/0082; G08G 5/0008; G08G 5/025; G01C 21/00; G05D 1/104; G01S 13/9303
See application file for complete search history.

(56) References Cited

U.S. PATENT DOCUMENTS 6,804,607 B1 10/2004 Wood
7,676,304 B2 * 3/2010 Colich ..... G08G 5/006 701/121
8,140,252 B2 3/2012 Wise et al.
2008/0021647 A1 * 1/2008 Daveze ..... G08G 5/045 701/301
2009/0125221 A1 * 5/2009 Estkowski ..... G05D 1/104 701/120
2010/0121503 A1 * 5/2010 Sundqvist ..... G05D 1/0287 701/11
2010/0286900 A1 * 11/2010 Depape ..... G08G 5/0008 701/120
2011/0118981 A1 * 5/2011 Chamlou ..... G08G 5/045 701/301
2011/0187561 A1 * 8/2011 Botargues et al. ..... G01S 13/9303 340/961
2012/0209457 A1 * 8/2012 Bushnell ..... G01C 21/00 701/13
2012/0319871 A1 * 12/2012 Wise ..... B64F 1/20 340/961

OTHER PUBLICATIONS

Kuchar et al., "The traffic alert and collision avoidance system," Lincoln Laboratory Journal (2007) 16(2):277-296.

(Continued)

*Primary Examiner* — Mirza F Alam
(74) *Attorney, Agent, or Firm* — Morrison & Foerster LLP

(57) ABSTRACT

A collision warning method includes receiving a collision risk indication from a traffic collision avoidance system of an aircraft, receiving a preset altitude, comparing the preset altitude and an altitude associated with the collision risk indication, and providing a warning in the aircraft when the preset altitude and the altitude associated with the collision risk are within a threshold.

20 Claims, 6 Drawing Sheets

(56) References Cited

OTHER PUBLICATIONS

Learmount, "Airbus modifies TCAS to avoid false 'climb collision' warning," Flight Global. Published Mar. 4, 2011. Retrieved on Jul. 10, 2018. Retrieved from https://www.flightglobal.com/news/articles/airbus-modifies-tcas-to-avoid-false-climb-collision-353888/.

U.S Department of Transportation Federal Aviation Administration, "Introduction to TCAS II version 7.1," Published Feb. 28, 2011. Retrieved on Jul. 10, 2018. Retrieved from https://www.faa.gov/documentLibrary/media/Advisory_Circular/TCAS%20II%20V7.1%20Intro%20booklet.pdf.

U.S Department of Transportation Federal Aviation Administration, "Airworthiness Approval of Traffic Alert and Collision Avoidance Systems (TCAS II), Versions 7.0 & 7.1 and Associated Mode S Transponders," Published Jul. 21, 2017. Retrieved on Jul. 10, 2018. Retrieved from https://www.faa.gov/documentLibrary/media/Advisory_Circular/AC_20-151C.pdf.

Willman, "False Alarms Buffet Pilots, Air Controllers," Los Angeles Times. Published Apr. 6, 1998. Retrieved on Jul. 10, 2018. Retrieved on http://articles.latimes.com/1998/apr/06/news/mn-36621.

* cited by examiner

AIRCRAFT TRAFFIC COLLISION AVOIDANCE

FIELD OF THE DISCLOSURE

This disclosure generally relates to systems and methods for safely flying an aircraft. More particularly, this disclosure relates to systems and methods for providing a collision warning using an aircraft traffic collision avoidance system.

BACKGROUND

Traffic collision avoidance systems ("TCAS") are designed to reduce mid-air collisions. Two aircraft communicate with one another to provide some or all of their positions, altitudes, speeds, and bearings. With this information, a TCAS projects the flight paths of both aircrafts and determines if there is collision risk. If there is a collision risk, the TCAS issues a warning. Then, the pilot is required to take control of the aircraft (if the aircraft is in autopilot mode) and make adjustments to avoid a collision.

TCASs may give false warnings. In such situations, requiring a pilot to take over control of the aircraft is not just inconvenient, it can causes accidents when an unprepared pilot is suddenly required to take control of the aircraft.

SUMMARY

This disclosure relates to systems and methods for providing a collision warning using a TCAS and a preset altitude. Advantageously, the methods and systems may reduce the number of false alarms, thereby improving flight safety and pilot experience.

In one embodiment, a collision warning method includes receiving a collision risk from a TCAS of an aircraft, receiving a preset altitude, comparing the preset altitude and an altitude associated with the collision risk, and providing a warning in the aircraft when the preset altitude and the altitude associated with the collision risk are within a threshold. Advantageously, the method may reduce the number of false alarms, thereby improving flight safety and pilot experience.

In some embodiments, receiving a preset altitude comprises receiving a preset altitude of the aircraft. In some embodiments, receiving a preset altitude comprises receiving a preset altitude of another aircraft.

In some embodiments, an autopilot system of the aircraft provides the preset altitude. In some embodiments, an autopilot system of another aircraft provides the preset altitude.

In one embodiment, a collision warning method includes: receiving, within a first aircraft, an airspeed and an altitude of the first aircraft; receiving, within the first aircraft, an airspeed and an altitude of a second aircraft; receiving, within the first aircraft, a preset altitude; determining, within the first aircraft, a collision risk between the first and second aircraft based on the airspeed and the altitude of the first aircraft, the airspeed and the altitude of the second aircraft, and the preset altitude; and providing, within the first aircraft, a warning when the collision risk exceeds a threshold. Advantageously, the method may reduce the number of false alarms, thereby improving flight safety and pilot experience.

In some embodiments, receiving a preset altitude comprises receiving a preset altitude of the first aircraft. In some embodiments, receiving a preset altitude comprises receiving a preset altitude of the second aircraft.

In some embodiments, the collision risk exceeds a threshold when a projected trajectory of the first aircraft is within a predetermined distance of a projected trajectory of the second aircraft.

In some embodiments, an autopilot system of the first aircraft provides the preset altitude. In some embodiments, an autopilot system of the second aircraft provides the preset altitude.

In one embodiment, an aircraft collision warning system includes: a TCAS in an aircraft; a processor in the aircraft that receives a collision risk indication from the TCAS, receives a preset altitude, compares the preset altitude and an altitude associated with the collision risk indication, and transmits a collision risk signal when the preset altitude and the altitude associated with the collision risk indication are within a threshold; and an alarm that receives the collision risk signal and provides an audible or visual warning in the aircraft. Advantageously, the system may reduce the number of false alarms, thereby improving flight safety and pilot experience.

In some embodiments, the preset altitude is a preset altitude of the aircraft. In some embodiments, the preset altitude is a preset altitude of another aircraft.

In some embodiments, an autopilot system of the aircraft provides the preset altitude. In some embodiments, an autopilot system of another aircraft provides the preset altitude.

In one embodiment, a collision warning system in a first aircraft includes: an airspeed indicator, an altimeter, a transponder, and an alarm that provides a warning when the collision risk between the first aircraft and a second aircraft exceeds a threshold. In some embodiments, the collision risk is based on the airspeed and the altitude of the first aircraft, the airspeed and the altitude of the second aircraft, and a preset altitude. In some embodiments, the airspeed indicator provides the airspeed of the first aircraft. In some embodiments, the altimeter provides the altitude of the first aircraft. In some embodiments, the transponder receives the airspeed and the altitude of the second aircraft. Advantageously, the method may reduce the number of false alarms, thereby improving flight safety and pilot experience.

In some embodiments, the preset altitude comprises a preset altitude of the first aircraft. In some embodiments, the system further comprises an autopilot to provide the preset altitude.

In some embodiments, the preset altitude comprises a preset altitude of the second aircraft. In some embodiments, the collision risk exceeds a threshold when a projected trajectory of the first aircraft is within a predetermined distance of a projected trajectory of the second aircraft.

DETAILED DESCRIPTION

In the following description of embodiments, reference is made to the accompanying drawings which form a part hereof, and in which it is shown by way of illustration specific embodiments in which the claimed subject matter may be practiced. It is to be understood that other embodiments may be utilized and structural changes may be made without departing from the scope of the claimed subject matter.

This disclosure relates to systems and methods for providing a collision warning using a TCAS and a preset altitude. Advantageously, the methods and systems may reduce the number of false alarms, thereby improving flight safety and pilot experience.

Figure 1A:
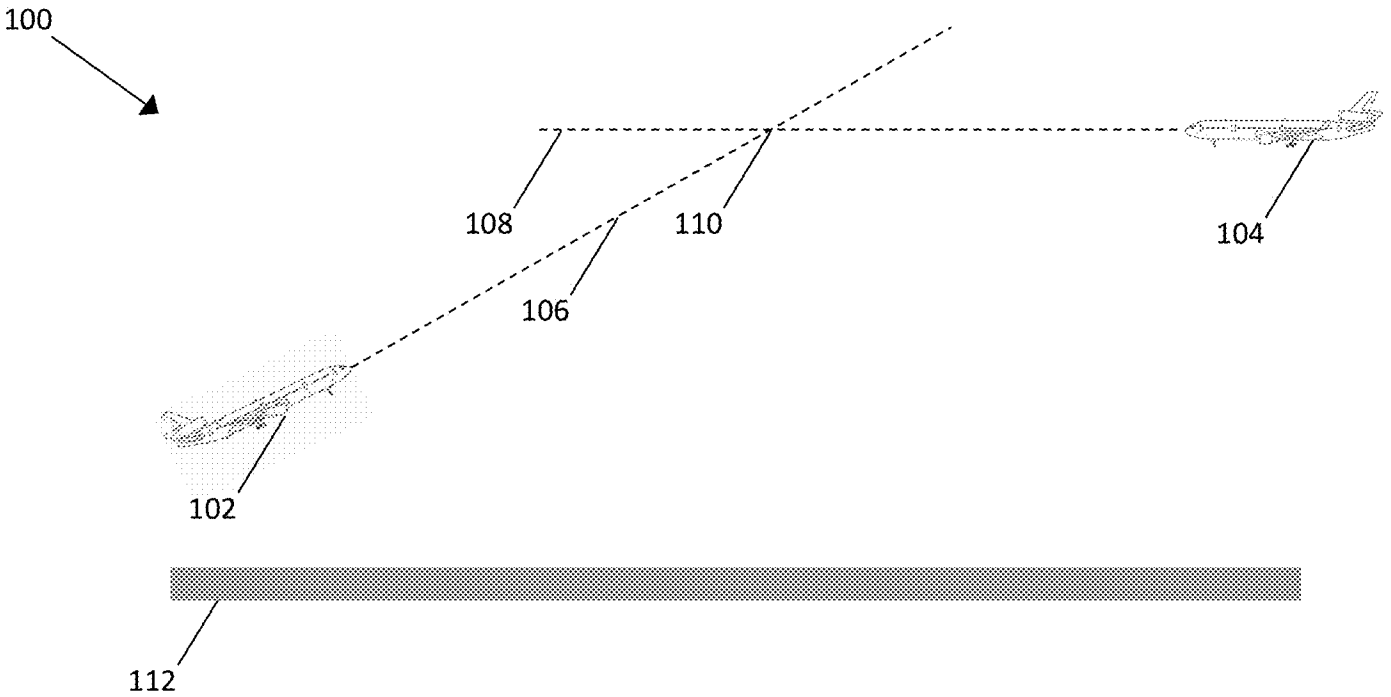
FIG. 1A depicts two aircraft during flight.

FIG. 1A depicts first aircraft 102 and second aircraft 104 during flight. First aircraft 102 has taken off and is climbing from a runway 112. Second aircraft 104 is cruising at an altitude above first aircraft 102.

A TCAS (not shown) in first aircraft 102 projects a flight path 106 for first aircraft 102 based on the altitude and airspeed of the first aircraft 102. The TCAS may also include a bearing of first aircraft 102 when projecting the flight path.

The TCAS also projects a flight path 108 for second aircraft 104. This may include receiving an altitude and airspeed of second aircraft 104, which may be sent by second aircraft 104 and received by a transponder on first aircraft 102. The TCAS may also utilize a bearing of second aircraft 104, which can be transmitted by second aircraft 104 or calculated using characteristics of the transmitted signal between the first aircraft 102 and the second aircraft 104.

As illustrated in FIG. 1A, projected path 106 and projected path 108 intersect. This presents a collision risk. In light of the collision risk, the TCAS in first aircraft 102 will issue an alarm and TCAS protocol will be followed.

As used herein, a "collision risk" can be understood to include a likelihood of collision. An intersection of projected paths may not be necessary for issuing a collision risk. In some embodiments, a collision risk includes projecting flight paths that are within a threshold distance of one another at a point in time.

A similar procedure may be followed by a TCAS (not shown) in second aircraft 104.

Figure 1B:
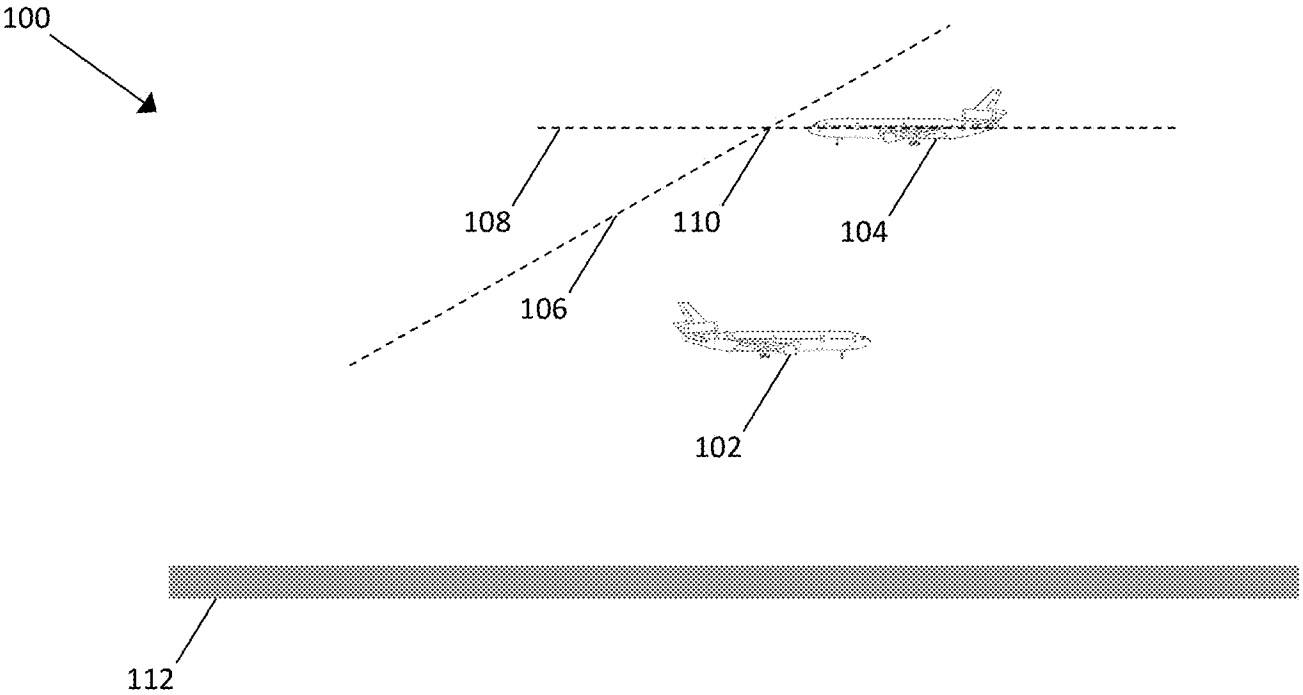
FIG. 1B depicts the two aircraft of FIG. 1A at a later time.

FIG. 1B depicts the scenario of FIG. 1A at a later time. Second aircraft 104 continued cruising, and is on its projected flight path 108. First aircraft 102 however is not on its projected flight path 106. This may occur when a pilot of first aircraft 102 alters the flight path in light of a TCAS alarm. This may also occur if first aircraft 102 had a preset altitude in autopilot (and autopilot remained on until the time illustrated in FIG. 1B). That is, if first aircraft 102's autopilot was preset to a cruising altitude below a collision risk altitude, then first aircraft 102 would have cruised at a lower altitude and there was no risk of a collision. In that scenario, a collision risk alarm was issued in error.

Figure 2:
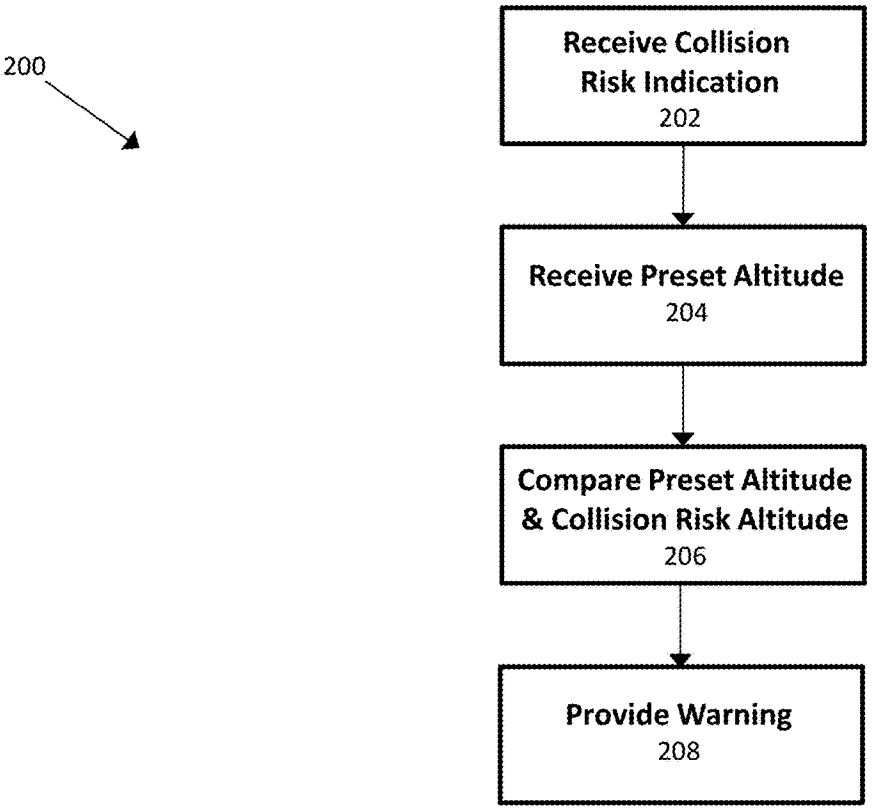
FIG. 2 depicts a collision warning method, in accordance with an embodiment.

FIG. 2 depicts collision warning method 200, in accordance with an embodiment. Collision warning method 200 includes receiving a collision risk indication from a TCAS of a first aircraft 202, receiving a preset altitude 204, comparing the preset altitude and an altitude associated with the collision risk indication 206, and providing a warning in the first aircraft when the preset altitude and the altitude associated with the collision risk indication are within a threshold 208. Advantageously, the method may reduce the number of false alarms, thereby improving flight safety and pilot experience.

In some embodiments, receiving a preset altitude comprises receiving a preset altitude of the first aircraft. In some embodiments, receiving a preset altitude comprises receiving a preset altitude of a second aircraft.

In some embodiments, an autopilot system of the first aircraft provides the preset altitude. In some embodiments, an autopilot system of a second aircraft provides the preset altitude.

Figure 3:
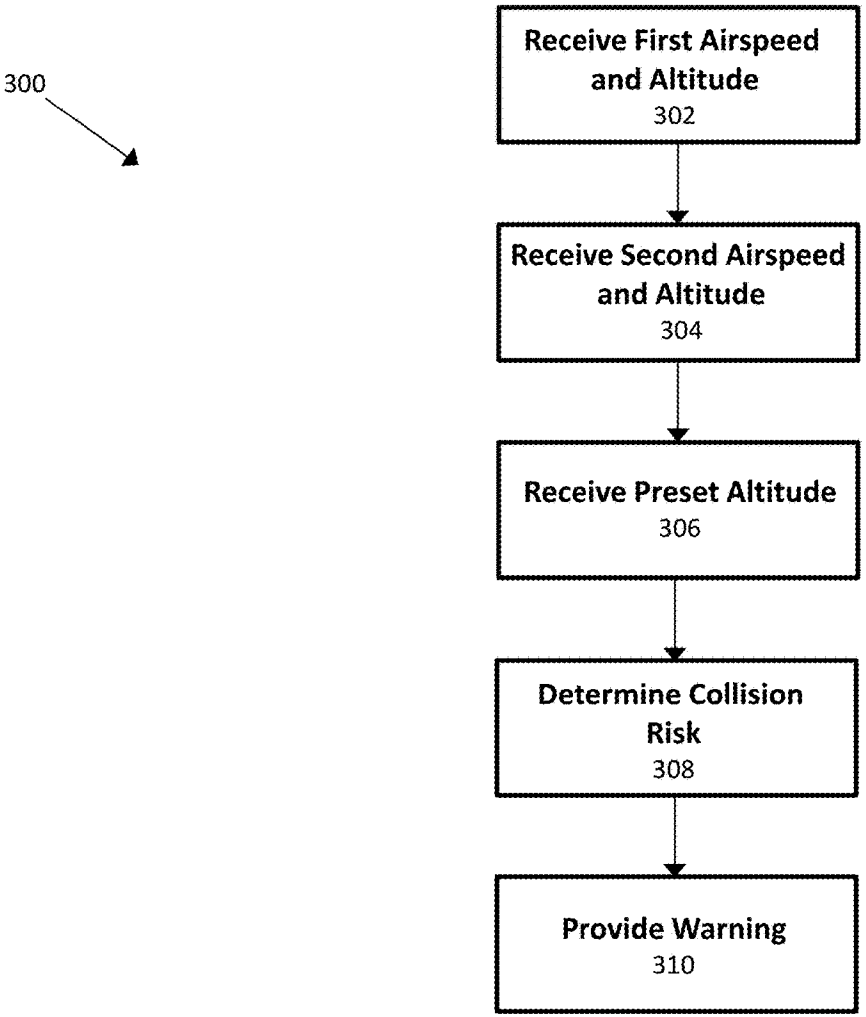
FIG. 3 depicts a collision warning method, in accordance with an embodiment.

FIG. 3 depicts collision warning method 300, in accordance with an embodiment. Collision warning method 300 includes receiving, within a first aircraft, an airspeed and an altitude of the first aircraft 302. Step 304 includes receiving, within the first aircraft, an airspeed and an altitude of a second aircraft. Step 306 includes receiving, within the first aircraft, a preset altitude. Step 308 includes determining, within the first aircraft, a collision risk between the first and second aircraft based on the airspeed and the altitude of the first aircraft, the airspeed and the altitude of the second aircraft, and the preset altitude. Step 310 includes providing, within the first aircraft, a warning when the collision risk exceeds a threshold. Advantageously, the method may reduce the number of false alarms, thereby improving flight safety and pilot experience.

In some embodiments, receiving a preset altitude comprises receiving a preset altitude of the first aircraft. In some embodiments, receiving a preset altitude comprises receiving a preset altitude of the second aircraft.

In some embodiments, the collision risk exceeds a threshold when a projected trajectory of the first aircraft is within a predetermined distance of a projected trajectory of the second aircraft.

In some embodiments, an autopilot system of the first aircraft provides the preset altitude. In some embodiments, an autopilot system of the second aircraft provides the preset altitude.

Figure 4:
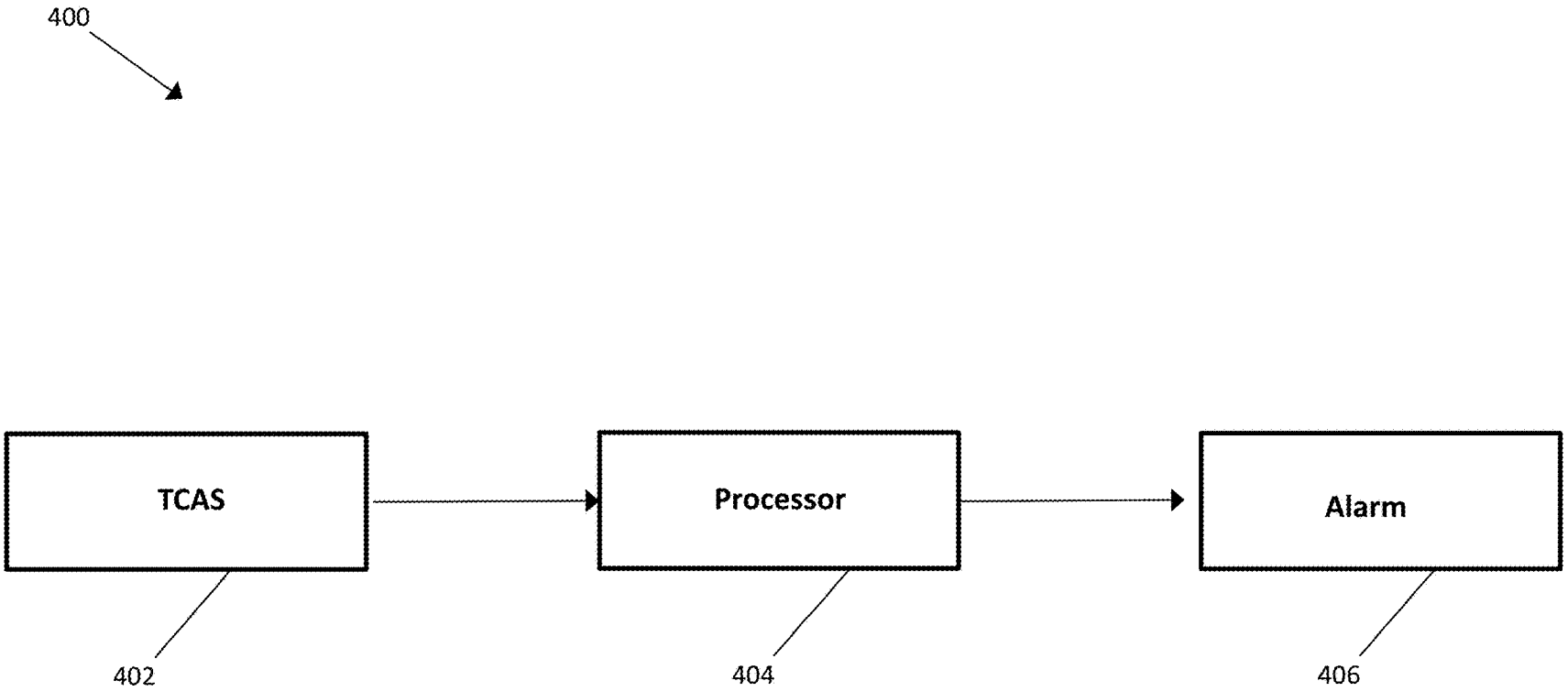
FIG. 4 depicts an aircraft collision warning system, in accordance with an embodiment.

FIG. 4 depicts aircraft collision warning system 400, in accordance with an embodiment. System 400 includes TCAS 402, processor 404, and alarm 406 installed in a first aircraft. Processor 404 receives a collision risk indication from the TCAS 402, receives a preset altitude, compares the preset altitude and an altitude associated with the collision risk indication, and transmits a collision risk signal when the preset altitude and the altitude associated with the collision risk indication are within a threshold. Alarm 406 receives the collision risk signal and provides an audible or visual warning in the first aircraft. Advantageously, the system may reduce the number of false alarms, thereby improving flight safety and pilot experience.

In some embodiments, the preset altitude is a preset altitude of the first aircraft. In some embodiments, the preset altitude is a preset altitude of a second aircraft.

In some embodiments, an autopilot system of the first aircraft provides the preset altitude. In some embodiments, an autopilot system of a second aircraft provides the preset altitude.

In some embodiments, the TCAS may be a Honeywell Model SmartTraffic™ CAS 100, a Rockwell Collins Model TCS-4000 or TCS-4001, an ACSS (L3) Model TCAS 2000 or TCAS 3000SP, or a Garmin GTS™ 8000.

In some embodiments, the processor transmits a collision risk signal and receives a collision risk and a preset altitude via communication lines, which could be hard-wired or wireless.

Figure 5:
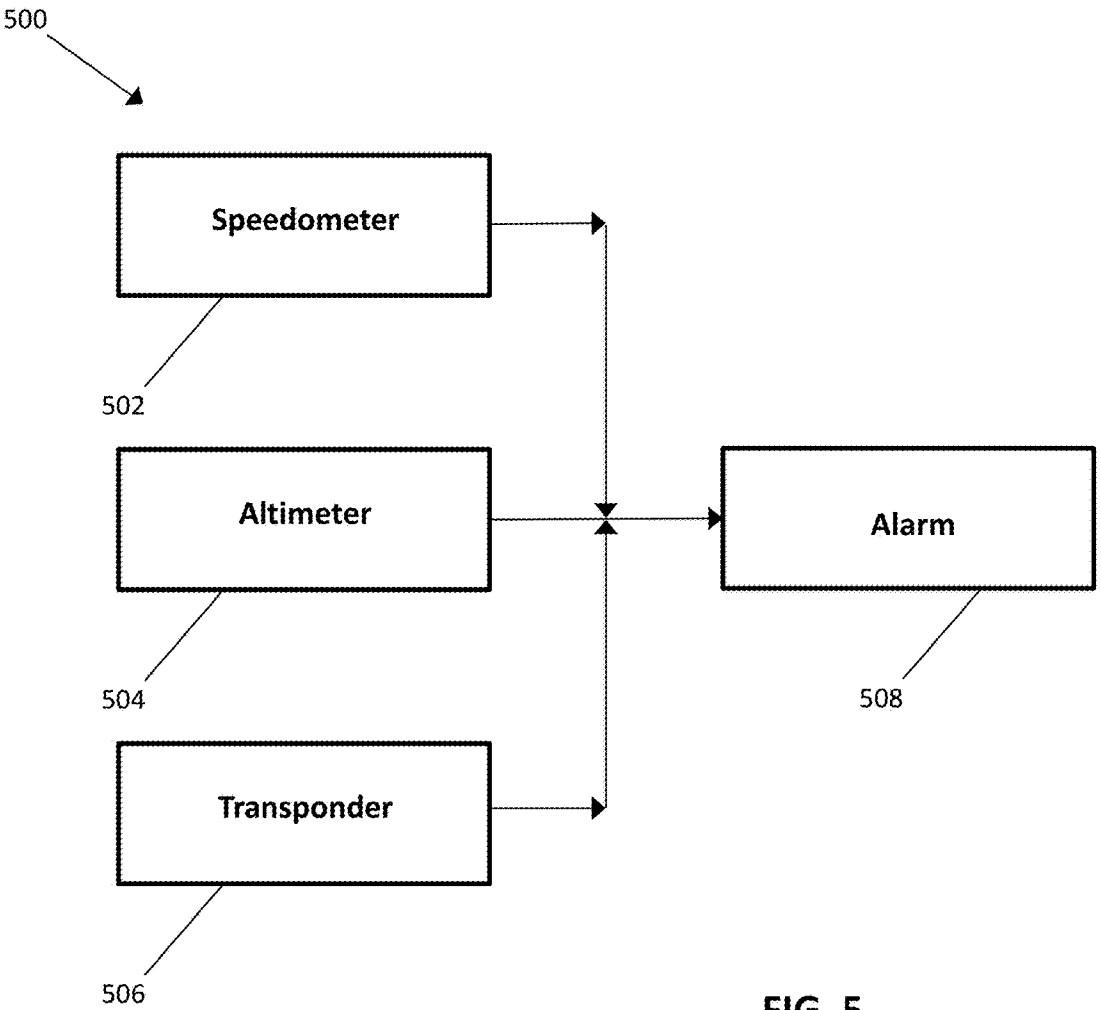
FIG. 5 depicts an aircraft collision warning system, in accordance with an embodiment.

FIG. 5 depicts aircraft collision warning system 500, in accordance with an embodiment. Collision warning system 500 is installed in a first aircraft and includes an airspeed indicator 502, an altimeter 504, a transponder 506, and an alarm 508. Airspeed indicator 502 provides the airspeed of the first aircraft, the altimeter 504 provides the altitude of the first aircraft, and the transponder 506 receives the airspeed and the altitude of a second aircraft. Alarm 508 provides a warning when a collision risk between a first aircraft and a second aircraft exceeds a threshold, where the collision risk is based on the airspeed and the altitude of the first aircraft, the airspeed and the altitude of the second aircraft, and a preset altitude. Advantageously, the system may reduce the number of false alarms, thereby improving flight safety and pilot experience.

In some embodiments, the preset altitude comprises a preset altitude of the first aircraft. In some embodiments, the system further comprises an autopilot to provide the preset altitude.

In some embodiments, the preset altitude comprises a preset altitude of the second aircraft. In some embodiments, the collision risk exceeds a threshold when a projected trajectory of the first aircraft is within a predetermined distance of a projected trajectory of the second aircraft.

In some embodiments, airspeed indicator 502 may be one commercially provided by Honeywell, Rockwell Collins, or Thommen Aircraft Equipment. In some embodiments, altimeter 504 may be one commercially provided by Honeywell, Rockwell Collins, Thommen Aircraft Equipment, or Innovative Solutions and Support. In some embodiments, transponder 506 may be one commercially provided by Honeywell, Rockwell Collins, ACSS (L3), or Garmin. In some embodiments, alarm 508 may be a flashing light or a horn.

In some embodiments, the collision risk is determined by a processor on the first aircraft.

One skilled in the relevant art will recognize that many possible modifications and combinations of the disclosed embodiments can be used, while still employing the same basic underlying mechanisms and methodologies. The foregoing description, for purposes of explanation, has been written with references to specific embodiments. However, the illustrative discussions above are not intended to be exhaustive or to limit the disclosure to the precise forms disclosed. Many modifications and variations can be possible in view of the above teachings. The embodiments were chosen and described to explain the principles of the disclosure and their practical applications, and to enable others skilled in the art to best utilize the disclosure and various embodiments with various modifications as suited to the particular use contemplated.

Further, while this specification contains many specifics, these should not be construed as limitations on the scope of what is being claimed or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

What is claimed is:

1. A collision warning method for a traffic collision avoidance system (TCAS) of a first aircraft comprising:

receiving, within the first aircraft, a current altitude of the first aircraft;

receiving, within the first aircraft, a velocity and a current altitude of a second aircraft, wherein the TCAS is configured to project a collision risk between the first and second aircraft based on the current altitude of the first aircraft and the velocity and current altitude of the second aircraft;

receiving, within the first aircraft, a preset altitude of the first aircraft from the first aircraft and a preset altitude of the second aircraft from the second aircraft;

determining, within the first aircraft, a likelihood of collision between the first and second aircraft based on the preset altitudes;

providing, using the TCAS of the first aircraft, a collision warning when the likelihood of collision exceeds a threshold; and forgoing the collision warning when the likelihood of collision does not exceed the threshold.

2. The method of claim 1, wherein determining the likelihood of collision comprises comparing a preset altitude to an altitude associated with the collision risk projected using the current altitude of the first aircraft and the velocity and current altitude of the second aircraft.

3. The method of claim 1, wherein the current altitude of the second aircraft is different than the preset altitude of the second aircraft.

4. The method of claim 1, wherein a likelihood of collision exceeds a threshold when two preset altitudes are within a threshold distance.

5. The method of claim 1, wherein the current altitude of the first aircraft is different than the preset altitude of the first aircraft.

6. An aircraft collision warning system for a first aircraft, the first aircraft at a first altitude, the system comprising a non-transitory machine-readable medium on which are stored instructions that, when executed, cause the system to:

receive a preset altitude of the first aircraft from the first aircraft and a preset altitude of a second aircraft from the second aircraft, wherein the second aircraft is at a velocity and a second altitude, wherein a TCAS of the first aircraft is configured to project a collision risk between the first and second aircraft based on the velocity of the second aircraft, the first altitude, and the second altitude;

determine a likelihood of collision between the first aircraft and the second aircraft based on the preset altitudes;

transmit a collision risk signal when the likelihood of collision is within a threshold; and forgo transmitting the collision risk signal when the likelihood of collision does not exceed the threshold.

7. The system of claim 6, wherein determining the likelihood of collision comprises comparing a preset altitude to an altitude associated with the collision risk projected using the current altitude of the first aircraft and the velocity and current altitude of the second aircraft.

8. The system of claim 6, wherein the current altitude of the second aircraft is different than the preset altitude of the second aircraft.

9. The system of claim 6, wherein the current altitude of the first aircraft is different than the preset altitude of the first aircraft.

10. The system of claim 6, wherein determining the likelihood of collision comprises comparing the preset altitudes.

11. The method of claim 1, wherein determining the likelihood of collision comprises comparing the preset altitudes.

12. The method of claim 3, wherein determining the likelihood of collision comprises comparing a preset altitude to an altitude-associated with the collision risk projected using the current altitude of the first aircraft and the velocity and current altitude of the second aircraft.

13. The method of claim 3, wherein a likelihood of collision exceeds a threshold when two preset altitudes are within threshold distance.

14. The method of claim 3, wherein the current altitude of the first aircraft is different than the preset altitude of the first aircraft.

15. The method of claim 3, wherein determining the likelihood of collision comprises comparing the preset altitudes.

16. The system of claim 6, wherein a likelihood of collision exceeds a threshold when two preset altitudes are within a threshold distance.

17. The system of claim 8, wherein the likelihood of collision comprises comparing a preset altitude to an altitude associated with the collision risk projected using the current altitude of the first aircraft and the velocity and current altitude of the second aircraft.

18. The system of claim 8, wherein the current altitude of the first aircraft is different than the preset altitude of the first aircraft.

19. The system of claim 8, wherein determining the likelihood of collision comprises comparing the preset altitudes.

20. The system of claim 8, wherein a likelihood of collision exceeds a threshold when two preset altitudes are within a threshold distance.

* * * * *